US006227536B1

(12) United States Patent
Bethke

(10) Patent No.: US 6,227,536 B1
(45) Date of Patent: May 8, 2001

(54) RECEIVING TRAY INSERT

(75) Inventor: Darvin R. Bethke, Edina, MN (US)

(73) Assignee: Moore North America, Inc., Grand Island, NY (US)

( * ) Notice: Subject to any disclaimer, the term of this patent is extended or adjusted under 35 U.S.C. 154(b) by 0 days.

(21) Appl. No.: 09/277,097

(22) Filed: Mar. 26, 1999

(51) Int. Cl.[7] ..... B65H 31/00
(52) U.S. Cl. ..... 271/207; 271/219; 399/406
(58) Field of Search ..... 399/406; 271/207, 271/219

(56) References Cited

U.S. PATENT DOCUMENTS

| | | | | |
|---|---|---|---|---|
| Re. 34,948 | * | 5/1995 | Aizawa et al. | 347/138 X |
| D. 297,476 | | 8/1988 | Ross et al. . | |
| D. 357,273 | | 4/1995 | Hocking . | |
| 4,095,782 | * | 6/1978 | Breuers et al. | 271/173 X |
| 4,718,657 | * | 1/1988 | Otter et al. | 271/184 X |
| 5,263,701 | * | 11/1993 | Kleinhen | 271/145 X |
| 5,737,987 | * | 4/1998 | Olson et al. | 83/89 X |
| 5,915,687 | * | 6/1999 | Rieck | 271/207 |

FOREIGN PATENT DOCUMENTS

| | | | | |
|---|---|---|---|---|
| 002059521 | * | 7/1993 | (CA) | 271/207 |
| 0100060 | * | 6/1983 | (JP) | 271/207 |
| 0125562 | * | 7/1983 | (JP) | 271/207 |
| 0215464 | * | 9/1987 | (JP) | 271/207 |
| 0313256 | * | 12/1989 | (JP) | 271/207 |
| 404201945 | * | 7/1992 | (JP) | 271/207 |

* cited by examiner

*Primary Examiner*—Christopher P. Ellis
*Assistant Examiner*—Kenneth W Bower
(74) *Attorney, Agent, or Firm*—Simpson, Simpson & Snyder, LLP

(57) ABSTRACT

A receiving tray insert for receiving and straightening curled printed paper discharged face down from a printer, comprising a planar member having a flat upper surface arranged to face away from the printer and arranged to receive the printed paper as it is ejected from the printer, and also having a lower surface arranged to face the printer, and also having elevating and spacing means secured to the lower surface and arranged to elevate the insert relative to the printer to create and maintain a thermally insulating air gap between the insert and the printer.

5 Claims, 3 Drawing Sheets

FIG. 1
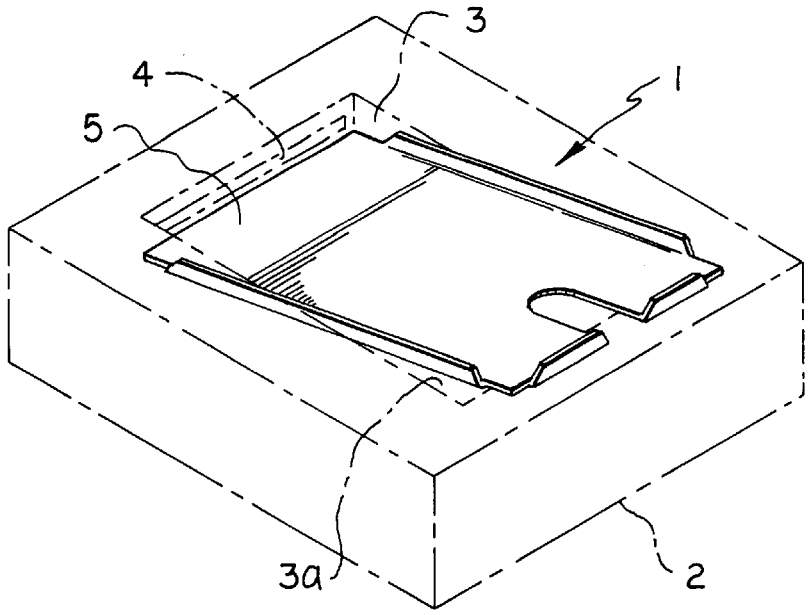
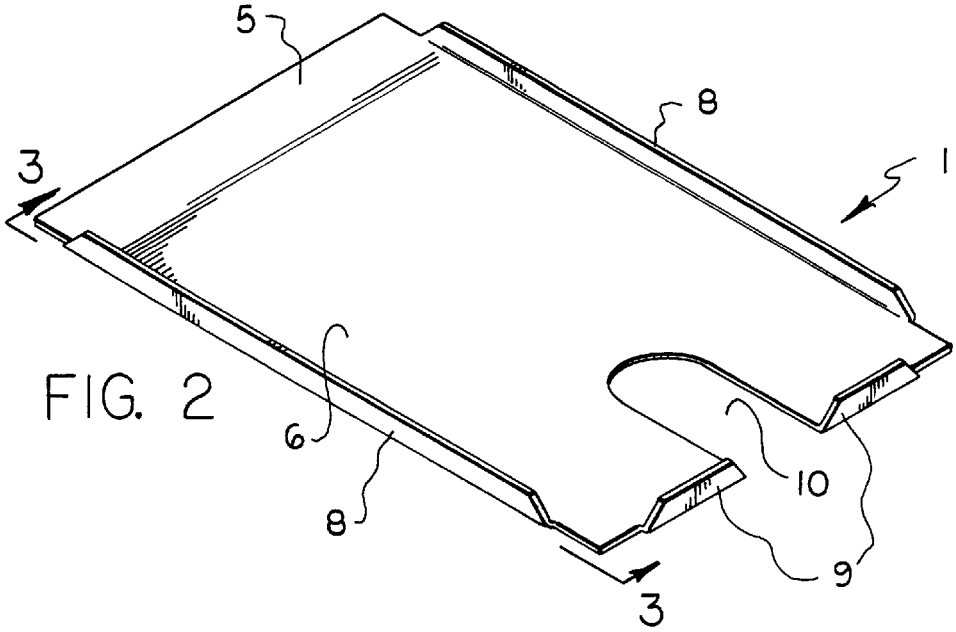
FIG. 2
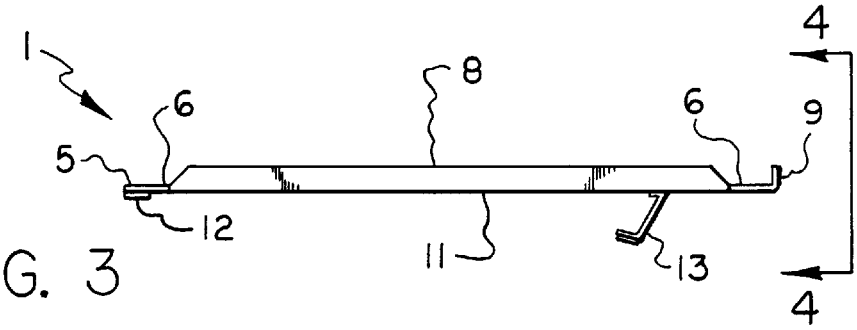
FIG. 3

RECEIVING TRAY INSERT

FIELD OF THE INVENTION

This invention relates generally to printers and copiers and, more particularly, to a receiving tray insert which functions to prevent curling of paper ejected from printers or copiers.

BACKGROUND OF THE INVENTION

In modern printers, such as laser printers, an item to be printed is reproduced as an image on a photosensitive surface. Electrically charged toner is distributed on the photosensitive surface in a pattern that reproduces the original image. The toner pattern is transferred to a receptive substrate, such as paper, in such a manner that the toner pattern reproduces the image on the paper. The toner is then permanently fused onto the paper and subsequently ejected or discharged from the machine.

Curling of the paper occurs during the fusion process. Heat is applied to the image side of the paper at a temperature of over 300° F. and pressure of about 7 kg. The heating operation causes moisture within the paper to dry unevenly such that more moisture is removed from the toner side of the paper than from the other side. This differential drying produces the curling effect.

An additional cause of curling is contraction of the toner particles as the paper cools. The heat generated during the fusion process causes the toner to expand. As it cools, the toner contracts causing the paper to contract and curl toward the toner side. As the paper cools further, curling increases.

Several models of printers incorporate a discharge tray into the shape of the printer case. Printed paper ejected from printers of this type is captured in a discharge tray that is exposed to the heat from the fusion process as heat radiates from the printer. Paper from these printers often is ejected face down so that the toner side is in contact with the printer. Thus, heat from the printer is also transmitted to the paper by conduction. Often these discharge trays have a curved shape. As the ejected paper cools, it tends to reabsorb moisture, curl toward the curved surface of the discharge tray and take on the curved shape of the discharge tray incorporated into the body of the printer.

Printed paper subjected to the above-described curling effect can cause problems when the paper is subsequently fed into other machines such as photocopiers. In addition, curled paper tends to take up more space in file storage cabinets and is more difficult to handle.

Thus, there is a need for an accessory device to certain types of printers to minimize and/or prevent the curling of printed paper ejected from these types of printers.

SUMMARY OF THE INVENTION

The present invention broadly comprises a receiving tray insert for receiving and straightening curled printed paper discharged face down from a printer, comprising a planar member having a flat upper surface arranged to face away from the printer and arranged to receive the printed paper as it is ejected from the printer, and also having a lower surface arranged to face the printer, and also having elevating and spacing means secured to the lower surface and arranged to elevate the insert relative to the printer to create and maintain a thermally insulating air gap between the insert and the printer. The invention also includes a method for preventing and/or minimizing curling of printed paper ejected from a printer.

A general object of the invention is to provide a means for preventing and/or minimizing curling of printed paper ejected face down from a printer.

Another object of the invention is to provide a means for flattening printed paper ejected face down from a printer.

A further object of the invention is to provide a means of reducing exposure to heat of printed paper ejected face down from a printer.

Still another object of the invention is to provide a thermally insulating air gap between a printer and printed paper ejected therefrom.

These and other objects, advantages and features of the present invention will become readily apparent to those having ordinary skill in the art from a reading of the following detailed description of the invention in view of the drawings and appended claims.

BRIEF DESCRIPTION OF THE DRAWINGS

FIG. 1 is a perspective view of the receiving tray insert resting in the discharge tray of a printer;

FIG. 2 is a perspective view of the receiving tray insert shown in FIG. 1;

FIG. 3 illustrates a side view of the receiving tray insert, taken generally along line 3—3 in FIG. 2;

DETAILED DESCRIPTION OF THE INVENTION

Figure 4:
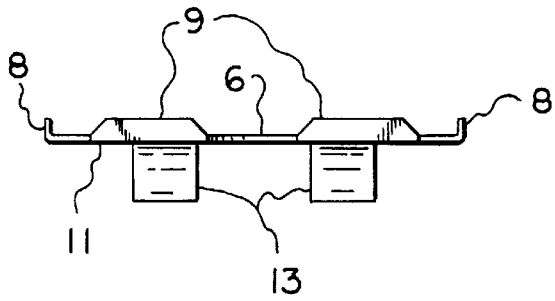
FIG. 4 is a front view of the receiving tray insert, taken generally along line 4—4 in FIG. 3.

In the discussion that follows, the following definitions apply:

"Printer" shall mean any machine capable of applying an image to paper or other substrate such as photocopiers and laser printers.

"Toner" shall mean any of a number of chemicals known in the art used to transfer an image onto a receiving substrate such as paper.

"Forward" shall mean the end of the receiving tray insert closest to the printer discharge port.

"Rear" shall mean the end of the receiving tray insert farthest from the printer discharge port.

The present invention is a device for receiving printed paper ejected or discharged face (toner) side down from a printer, for preventing additional curling of the printed paper, and for allowing the paper to maintain a flat shape as it cools. Specifically, the invention is a receiving tray insert which fits onto the top of the printer casing in such a manner as to receive the paper as it is ejected from the printer. In a typical embodiment, the receiving tray insert is placed in or on a curved discharge tray incorporated into the upper surface of the printer casing.

The flat upper surface of the invention retains the paper and this flat upper surface prevents further curling and serves to straighten the paper as it cools. The lower surface faces the printer and is provided with an elevating and spacing means so as to position the tray above the surface of the printer in such a manner as to create an air gap between the invention and the surface of the printer. This air gap provides a thermally insulating space which prevents further curling by blocking the heat radiating from the printer from contacting the paper in the receiving tray insert.

The discharged paper retains heat generated by the printing process. The retained heat causes the paper to curl toward the printed side. This curling effect is aggravated after discharge by heat radiating from the printer itself and by the curved shape of the discharge tray incorporated into the body of the printer. This curved shape of the incorporated discharge tray causes the discharged paper to acquire the shape or curve of the curved discharge tray. By receiving and holding the curled ejected material on the flat surface of the elevated receiving tray insert, the material will acquire the flat shape of the receiving tray insert. In addition, the material will be insulated from the heat radiating from the printer.

Adverting now to the drawings, FIG. 1 is a perspective view of the receiving tray insert 1 positioned in discharge tray 3 of printer 2. Discharge tray 3 is incorporated into the outer case of printer 2. Floor 3*a* of discharge tray 3 often has a curved shape (not shown). Receiving tray insert 1 has a flange 5 at its forward edge which fits under printer discharge port 4, allowing the receiving tray insert to catch the printed paper as it is discharged from printer 2.

FIG. 2 is a perspective view of receiving tray insert 1. Flange 5 is integral with upper surface 6. Upper surface 6 is flat and is of sufficient size to receive paper as it is ejected from the printer. As shown in FIG. 2, the receiving tray insert is equipped with side retaining lips 8 on each side edge of the receiving tray insert and rear retaining lips 9 on the rear edge of the insert to hold printed paper within the receiving tray after it is ejected from printer discharge port 4 (not shown). The rear end of the invention has a cutout 10 to allow easy removal of a paper stack held on the receiving tray insert.

FIG. 3 is a side view of receiving tray insert 1 taken generally along line 3—3 in FIG. 2. Lower surface 11 extends continuously from the forward edge of flange 5 to the rear edge of rear retaining lips 9. Secured to lower surface 11 is a forward elevating and spacing means 12 attached toward the forward end of lower surface 11. In a preferred embodiment, forward elevating and spacing means 12 is attached to lower surface 11 at the forward edge of receiving tray insert 1. Elevating and spacing means 12 may be constructed of any material capable of raising the forward edge of the invention off the floor 3*a* of printer discharge tray 3 to create a space between the forward edge of the invention and the printer discharge tray 3. Such material may include, but is not limited to, metal, plastic, or tape attached to the lower surface 11. Forward elevating and spacing means 12 may be a single device or may be a plurality of elevating and spacing means. A rear elevating and spacing means 13 is located toward the rear end of receiving tray insert 1 and functions to raise the lower surface 11 off the surface of the printer discharge tray 3. Such rear elevating and spacing means may be formed from metal, plastic or other suitable material known in the art. The elevating and spacing means is secured to the lower surface 11 of the receiving tray insert. Alternatively, one or both of front elevating and spacing means 12 and rear elevating and spacing means 13 may be incorporated into the structure of lower surface 11. In a preferred embodiment, lower surface 11 or the whole of receiving tray insert 1 may be constructed with a thermally insulating material capable of insulating printed paper accumulated on receiving tray insert 1 from heat emanating from the printer. Alternatively, lower surface 11 or the whole of receiving tray insert 1 may be coated with a thermally insulating material for the same insulating function. Such structural or coating insulating materials are well known in the art.

FIG. 4 is an end view of the invention taken generally along line 4—4 in FIG. 3. Rear elevating and spacing means 13 are shown as a pair of such means aligned under rear retaining lips 9. Other suitable arrangements of the rear elevating and spacing means can be made provided sufficient space is maintained to allow efficient dissemination of the heat emanating from the printer.

Figure 5:
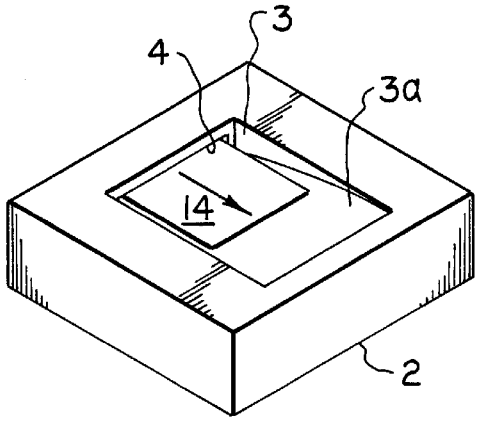
FIGS. 5–6 are perspective views which illustrate curling of paper ejected from a printer not having the insert tray of the present invention.
Figure 6:
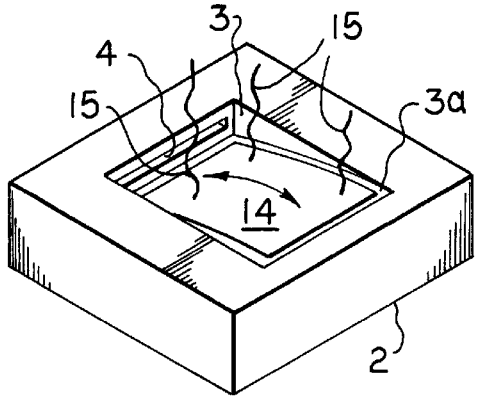

FIGS. 5 and 6 demonstrate how curling of printed paper from a printer takes place. In FIG. 5, printed paper 14 is discharged through printer discharge port 4 onto curved surface 3*a* of printer discharge tray 3. FIG. 6 shows the completely discharged paper resting on curved surface 3*a* exposed directly to heat 15 emitted from printer 2. This direct exposure to the emitted heat will magnify the curling effect produced during the printing process by allowing the paper to continue to curl by slowing the cooling process. The longer cooling period increases the period of time for the paper fibers to curl as the cooling toner fused into the paper continues to contract. When the paper cools, the curled paper fibers reabsorb moisture and subsequently conform to the shape of curved surface 3*a* upon which the paper is resting.

Figure 7:
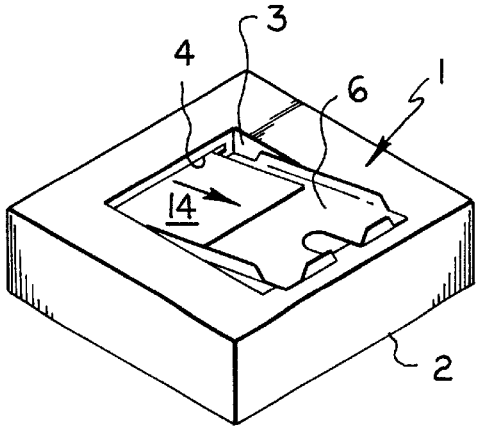
FIGS. 7–8 are perspective views similar to those of FIGS. 5–6 but showing how the insert tray of the invention prevents curling.
Figure 8:
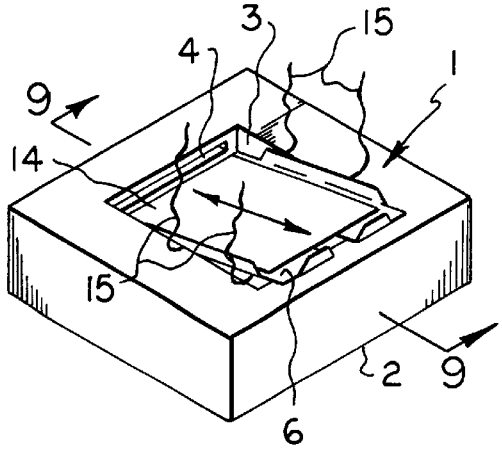

FIGS. 7 and 8 demonstrate how receiving tray insert 1 minimizes the inherent curling effect produced by the printer and acts to straighten the printed paper. In FIG. 7, printed paper 14 is ejected through printer discharge port 4 onto flat upper surface 6 of receiving tray insert 1. FIG. 8 shows the completely discharged paper resting on flat upper surface 6 of the invention. The front and rear elevating and spacing means (not shown) create and maintain a thermally insulating space between receiving tray insert 1 and printer 2. This insulating space reduces heat exposure 15 and consequently reduces the cooling period. In addition, as the paper cools, the paper fibers reabsorb and take on the shape of the flat upper surface, thereby creating flatter sheets of printed paper.

Figure 9:
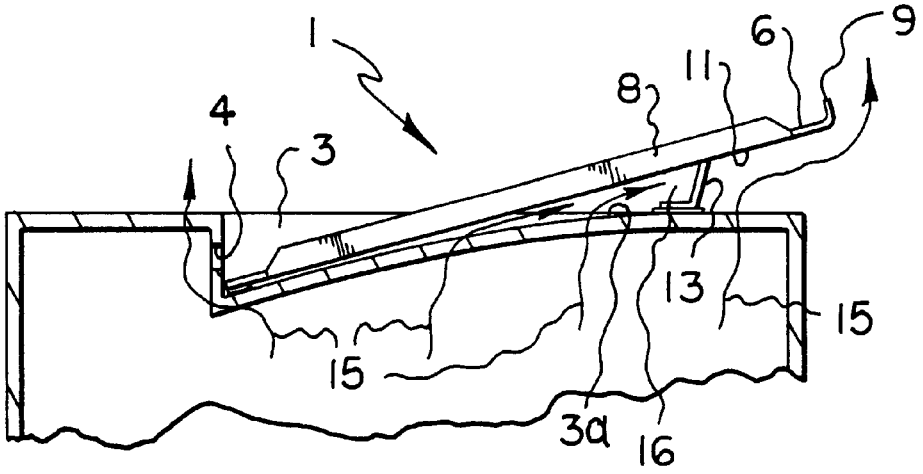
FIG. 9 is a fragmentary cross-sectional view of the printer and a side view of the receiving tray insert, taken generally along plane 9—9 in FIG. 1.

FIG. 9 is a fragmentary cross-sectional view of the printer and a side view of receiving tray insert 1, taken generally along line 9—9 in FIG. 8, and showing the insert positioned in printer discharge tray 3. This view illustrates how receiving tray insert 1 insulates printed material from heat generated by the printer. Forward elevating and spacing means (not shown) and rear elevating and spacing means 13 attached to lower surface 11 create a thermally insulating space 16 between the invention and the printer. This allows heat 15 to dissipate around the upper surface 6 of the receiving tray insert 1 and prevents the heat 15 from contacting the paper resting in the receiving tray insert.

Figure 10:
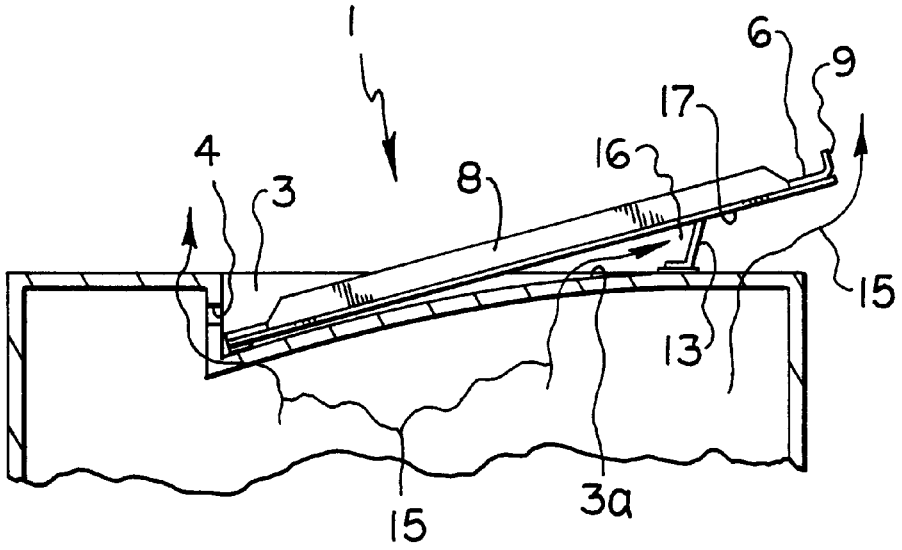
FIG. 10 is a fragmentary cross-sectional view similar to that of FIG. 9 except showing the heat shield in place on the bottom of the insert.

FIG. 10 is a fragmentary cross-sectional view of the printer and a side view of receiving tray insert 1, taken generally along line 9—9 in FIG. 8, illustrating a preferred embodiment in which the thermally insulating effect is enhanced by an insulating material 17 coating lower surface 11 (not shown) of the invention. In another preferred embodiment (not shown), lower surface 11 may be constructed of a thermally insulating material 17. In still another preferred embodiment (not shown), both upper surface 6 and lower surface 11 of receiving tray insert 1 may be coated with or constructed of thermally insulating material.

While the present invention has been described with respect to what is presently considered to be the preferred embodiments, it is understood that the invention is not limited to the disclosed embodiments. The present invention is intended to cover various modifications and equivalent arrangements included within the spirit and scope of the appended claims.

What is claimed is:

1. A conveyor-less receiving tray insert for receiving and straightening curled printed paper discharged face down from a printer having a discharge tray, comprising a single planar member having a flat upper surface arranged to face away from said printer and arranged to receive said printed paper immediately in a conveyor-less manner as it is ejected from said printer, and also having a lower surface arranged to face said printer, and also having elevating and spacing means secured to said lower surface and arranged to elevate said insert relative to said printer to create and maintain a thermally insulating air gap between said insert and said printer, said elevating and spacing means operatively arranged to secure said receiving tray insert proximate to said printer and within said printer discharge tray.

2. A receiving tray insert as recited in claim 1 wherein said elevating and spacing means function to maintain said insert in a substantially horizontal plane relative to said printer.

3. A receiving tray insert as recited in claim 1 wherein at least said lower surface is a thermally insulating surface.

4. A receiving tray insert as recited in claim 3 wherein at least said lower surface is constructed with a thermally insulating material.

5. A receiving tray insert as recited in claim 3 wherein at least said lower surface is coated with a thermally insulating material.

* * * * *